US005421064A

United States Patent [19]

Ishii et al.

[11] Patent Number: 5,421,064

[45] Date of Patent: Jun. 6, 1995

[54] FILAMENTS DISPERSING DEVICE

[75] Inventors: Hiroshi Ishii, Kuga; Katsuya Hata, Chiyoda; Yoshinori Kobayashi, Kuga, all of Japan

[73] Assignee: Mitsui Petrochemical Industries, Ltd., Tokyo, Japan

[21] Appl. No.: 154,729

[22] Filed: Nov. 19, 1993

Related U.S. Application Data

[63] Continuation of Ser. No. 952,500, Dec. 2, 1992, abandoned.

[30] Foreign Application Priority Data

Apr. 9, 1991 [JP] Japan ..... 3-76536

[51] Int. Cl.[6] ..... D01G 25/00

[52] U.S. Cl. ..... 19/296

[58] Field of Search ..... 19/296, 297, 298, 299, 19/300, 301, 302, 303, 304, 305, 306, 161.1

[56] References Cited

U.S. PATENT DOCUMENTS

| | | | |
|---|---|---|---|
| 3,334,161 | 8/1967 | De Guzman . | |
| 3,766,606 | 10/1973 | Piper et al. . | |
| 4,637,104 | 1/1987 | Mente | 91/296 X |
| 4,818,466 | 4/1989 | Mente et al. | 19/299 X |
| 4,964,197 | 10/1990 | Mente et al. | 19/296 X |

FOREIGN PATENT DOCUMENTS

| | | |
|---|---|---|
| 2163795 | 12/1973 | Germany . |
| 48-2907 | 1/1973 | Japan . |
| 49-430 | 1/1974 | Japan . |
| 60-231856 | 11/1985 | Japan . |
| 63-38461 | 6/1988 | Japan . |

*Primary Examiner*—Clifford D. Crowder
*Assistant Examiner*—Larry D. Worrell, Jr.
*Attorney, Agent, or Firm*—Sherman and Shalloway

[57] ABSTRACT

An object of the present invention is to provide a dispersing device which can disperse filaments uniformly and widely on a moving collector surface by suppressing the turbulence of an air flow as a carrier medium for the filaments to thereby reduce the disturbance of the filaments.

The dispersing device (1) of the present invention is formed as a dispersing pipe consisting of a pair of dispersing plates (2) vertically extending so as to be opposed to each other and a pair of side plates (3) connecting the dispersing plates. The dispersing pipe has an upper end formed with a filaments inlet and a lower end formed with an oblong filaments outlet (5) surrounded by the dispersing plates and the side plates. The dispersing pipe has a shape such that a space t between the dispersing plates is decreased with an increase in distance z from the filaments inlet toward the filaments outlet (5), and that a space w between the side plates is increased with the increase in the distance z. According to the dispersing device of the present invention, the turbulence of the carrier air flow is reduced to thereby uniformly and widely disperse the filaments on the moving collector surface (14). Accordingly, a web having a good appearance with less nonuniformity and less yarn bundles can be obtained.

7 Claims, 12 Drawing Sheets

FILAMENTS DISPERSING DEVICE

This application is a continuation of application Ser. No. 07/952,500, filed Dec. 2, 1992 now abandoned.

TECHNICAL FIELD

The present invention relates to a filaments dispersing device For the production of a nonwoven fabric, for flatly dispersing filaments carried by an air flow.

BACKGROUND ART

In a known producing method for a nonwoven fabric, numerous filaments ejected from a spinning nozzle are drawn by an air gun and are stretched. Then, the filaments are carried by an air flow into a guide tube, and are dispersed in a dispersing device (usually formed as a dispersing nozzle or a dispersing pipe). Then, the filaments are collected on a moving collector surface to thereby form a web.

In Japanese Patent Publication No. 47-24991, there is described a device for dispersing and depositing filaments to produce a fleece (a kind of web). As a dispersing portion of this device, there are shown in the above reference an example wherein a space w between opposed side plates (corresponding to side walls) of a dispersing pipe and a space t between opposed dispersing plates (facing parts of the dispersing pipe other than the opposed side plates) are linearly changed (FIG. 1 in the above reference); an example wherein the space w between the opposed side plates is increased toward an outlet (filaments outlet) of the dispersing pipe in such a manner that a radius of curvature of the opposed side plates is gradually decreased toward the outlet (FIG. 2(*a*) in the above reference); and an example wherein the space w between the opposed side plates is linearly increased along tangential lines of arcs and the arcs are connected with expanded ends of the tangential lines (FIG. 2(*b*) in the above reference).

However, in the dispersing device formed as the dispersing pipe as described in Japanese Patent Publication No. 47-24991, a change in sectional area of the device is large, or the space w between the opposed side plates is rapidly increased toward the filaments outlet. Accordingly, the air flow in the device separates from the opposed side plates and the opposed dispersing plates, causing remarkable turbulence of the air flow. As a result, the filaments carried by the air flow are largely disturbed to cause the generation of yarn bundles damaging the appearance of the web.

DISCLOSURE OF INVENTION

The present invention has been realized in view of the above circumstances, and it is an object of the present invention to provide a dispersing device which can disperse filaments uniformly and widely on a moving collector surface by suppressing the turbulence of an air flow as a carrier medium for the filaments to thereby reduce the disturbance of the filaments.

According to the present invention achieving the above object, there is provided a filaments dispersing device for the production of a nonwoven fabric, for dispersing filaments carried by an air flow and ejecting said filaments onto a moving collector surface, said filaments dispersing device being formed as a dispersing pipe comprising a pair of dispersing plates vertically extending so as to be opposed to each other and a pair of side plates connecting said dispersing plates, said dispersing pipe having an upper end formed with a filaments inlet and a lower end formed with an oblong filaments outlet surrounded by said dispersing plates and said side plates, said dispersing pipe having a shape such that a t between said dispersing plates is decreased with an increase in distance z from said filaments inlet toward said filaments outlet, and that a distance w between said side plates is increased with the increase in said distance z.

In the dispersing device of the present invention, it is preferable that a sectional area S of the dispersing pipe at an arbitrary portion thereof in a plane perpendicular to a line along the distance z (which sectional area will be hereinafter referred to simply as a sectional area S of the dispersing pipe) is represented by an expression approximated to Expression 1 to be given below, and that $dw/dz \geqq 0$and $d^2w/dz^2 \leqq 0.6$, preferably $d^2w/dz^2 \leqq 0.3$, more preferably $d^2w/d^20.006$ are satisfied for all values of the distance z.

Expression 1: $S = a \times z + b$ where a is a constant satisfying $-1.00 \leqq a \leqq 1.00$, preferably $a=0$; and b is a sectional area of the filaments inlet.

It is preferable that the space t between the dispersing plates is a monotone decreasing function of the distance z.

It is preferable that the space between the dispersing plates at the filaments outlet is 1 mm or more in consideration of operability.

It is preferable that a condition for carrying the filaments in the dispersing device having the above shape is such that an air velocity Va at the filaments outlet is represented by a ratio of Q/Send where Q represents a flow rate of the air flow and Send represents a sectional area of the filaments outlet, and that the air velocity Va is related with a filaments velocity Vf so as to satisfy $2Vf < Va < 4Vf$.

There will now be described a preferred embodiment of the present invention with reference to the drawings.

Referring to FIG. 5, there is shown a nonwoven fabric producing apparatus to which the present invention is applied. The nonwoven fabric producing apparatus includes a spinneret 11 as a spinning nozzle for filamentously extruding a molten resin, an air gun 12 provided below the spinneret 11 for receiving filaments A extruded from the spinneret 11, stretching the filaments A, and ejecting the same with a high-speed air flow, a guide tube 13 connected at an upper end thereof to the air gun 12 for carrying the filaments A with the air flow, and a moving collector surface 14 as an air permeable screen belt provided below the guide tube 13. Furthermore, a dispersing device 1 according to the present invention is provided at the level of about 100 to 600 mm above the moving collector surface 14 so that an upper end of the dispersing device 1 is directly connected to the guide tube 13.

The dispersing device 1 is constituted of a pair of flat dispersing plates 2 vertically straight extending so as to be opposed to each other as shown in FIG. 1 and a pair of side plates 3 connecting the dispersing plates 2 so as to be curved away from each other as shown in FIG. 2.

A distance z from a filaments inlet of the dispersing device 1 to a filaments outlet 5 thereof is set to about 20 to 400 mm. An outlet of the guide tube 13 is connected to the filaments inlet of the dispersing device 1 so that there is no step between an inner surface of the guide tube 13 and an inner surface of the dispersing device 1.

The guide tube 13 has an inner diameter of 6 to 20 mm, for example. About 200 filaments each having a size of 0.3 to 15 D (denier) are ejected with an air flow of 20 to 60 $Nm^3/hr$ from the guide tube 13.

In correspondence with that the inner diameter of the guide tube 13 is set to 6 to 20 mm, an inner diameter $t_O$ of the filaments inlet of the dispersing device 1 connected to the guide tube 13 is also set to 6 to 20 mm.

A space t between the opposed dispersing plates 2 is gradually decreased with an increase in value of the distance z from the filaments inlet, and a space $t_1$ at the filaments outlet 5 is set to 0.7 to 3 mm, for example. On the other hand, a space w between the opposed side plates 3 is gradually increased with an increase in value of the distance z from the filaments inlet.

As shown in FIG. 3, a horizontal cross section of the dispersing device 1 consisting of the dispersing plates 2 and the side plates 3 in combination (i.e., a cross section perpendicular to a line along the distance z, and having a sectional area S) is shaped so that it is substantially square at an upper end portion 4*a* of the dispersing device 1 where the value of the distance z is short; it is substantially rectangular at an intermediate portion 4*b* of the dispersing device 1 where the value of the distance z is medium; and it is flatly rectangular at a lower end portion 4*c* as the filaments outlet 5 of the dispersing device 1 in such a manner that each short side corresponding to the space t is set to 0.7 to 3 mm, for example, and each long side corresponding to the space w is set to 20 to 100 mm, for example.

In the dispersing device 1 shown in FIGS. 1 and 2, there is the following relation between the distance z and the distance w. That is, an inclination of the dispersing plates 2, dw/dz is set to zero or positive, and a rate of increase thereof, $d^2w/dz^2$ is set to 0.6 or less, preferably 0.3 or less. In particular, there is no step between the upper end of the device and the outlet 14 of the guide tube 13, so that the inclination, dw/dz at a connecting portion (z =0) is zero.

There is shown a relation among w, t, and S in FIG. 6. The relation is expressed as follows:

$t=-0.076\times z+9.000$ $S=-0.11\times z+81.00$ $S=w\times t$

The above expression of S and z is approximated to Expression 1 mentioned above.

The dispersing plates 2 and the side plates 3 are not limited to the flat plates as mentioned above, but they may be curved as viewed in horizontal cross section. For example, as shown in FIG. 4, the horizontal cross section of the dispersing device i consisting of the dispersing plates 2 and the side plates 3 in combination may be shaped so that it is substantially circular at an upper end portion 6*a* of the dispersing device 1; it is elliptical at an intermediate portion 6b of the dispersing device 1; and it is flatly elliptical at a lower end portion 6*c* as the filaments outlet 5 of the dispersing device 1 in such a manner that a major axis is much longer than a minor axis.

As a modification, the horizontal cross section may be so shaped as to combine the elliptical shape and the rectangular shape.

The filaments outlet 5 of the dispersing device 1 is located at the level of 100 to 600 mm from the screen belt 14. The filaments A carried through the guide tube 13 at high speeds are gathered in more convergent manner in opposed directions of the dispersing plates 2 and are spread in opposed directions of the side plates 3 along the curves of the side plates 3. Thus, the filaments A are uniformly dispersed in the dispersing device 1 and are then ejected from the filaments outlet 5.

In the nonwoven fabric producing apparatus as shown in FIG. 5 employing the filaments dispersing device as shown in FIGS. 1 and 2, the filaments A can be dispersed in the range of 600 mm or more by varying the height from the screen belt 14 or the velocity of the air flow, for example.

BEST MODE FOR CARRYING OUT THE INVENTION

An example of the present invention will now be described.

Figure 5:
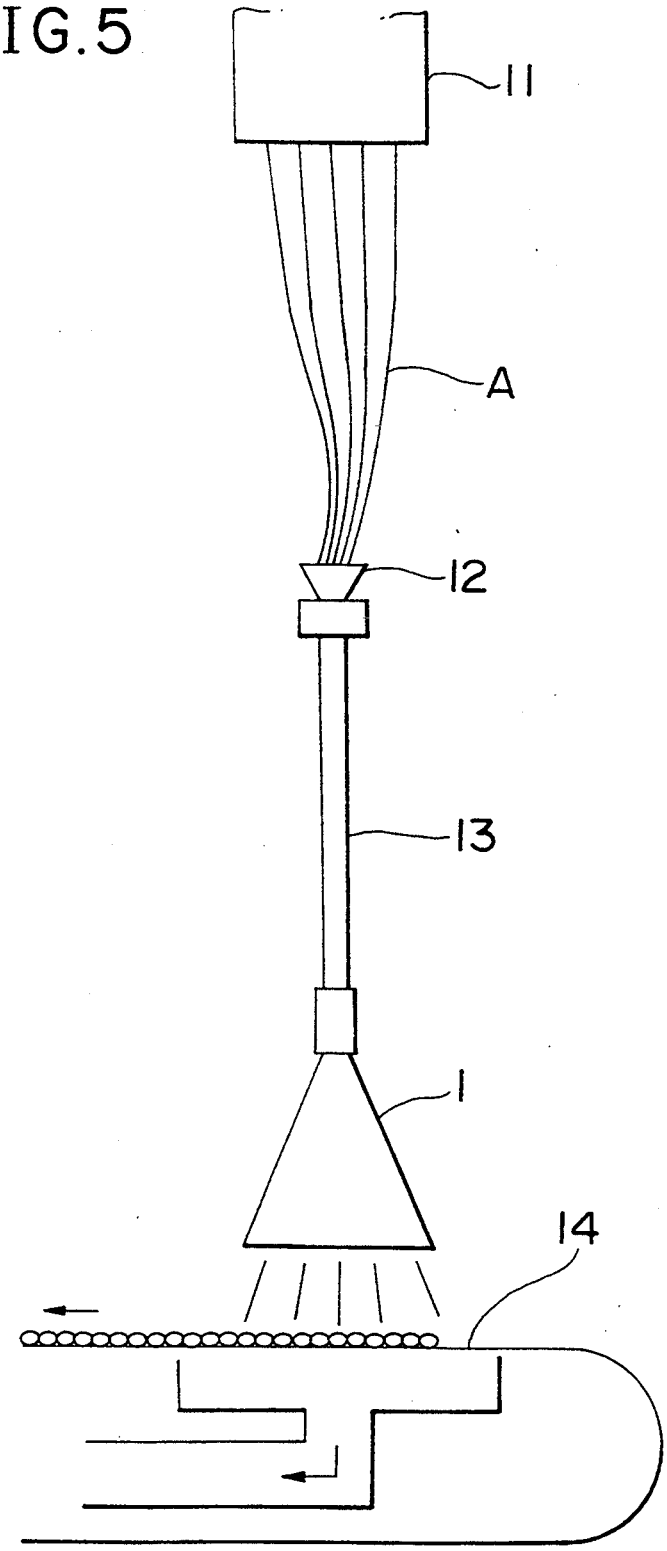
FIG. 5 is a schematic view of a nonwoven fabric producing apparatus employing the dispersing device of the present invention.

As shown in FIG. 5, the dispersing device (dispersing pipe) 1 of various shapes was connected to the guide tube 13 having an inner diameter of 10 mm. With an air flow of 42 $Nm^3/hr$, 100 polypropylene filaments A each having a size of 2 denier was carried at a velocity of Vf=3000 m/min. The screen belt 14 as the moving collector surface having a suction device was located below the filaments outlet of the dispersing device 1 by 150 mm. The filaments A ejected from the dispersing device 1 were collected on the screen belt 14 to obtain a web. The dispersing device 1 was disposed so that the dispersing plates were perpendicular to a moving direction of the moving collector surface 14. A dispersion width of the filaments A, an air velocity distribution from the filaments outlet, and an appearance of the web were evaluated.

EXAMPLE 1

Figure 1:
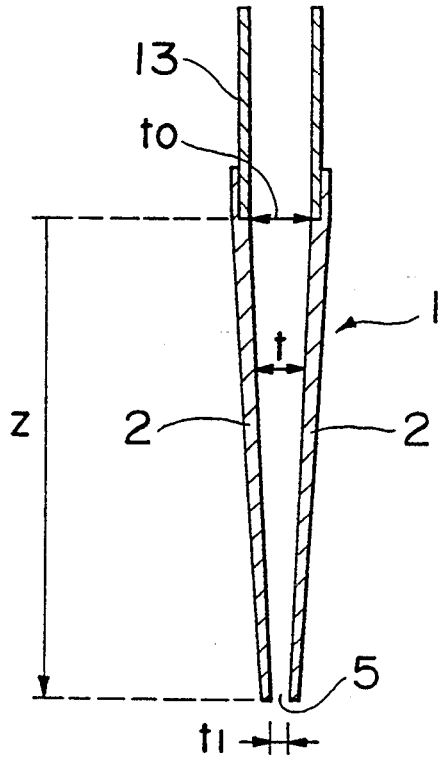
FIG. 1 is a vertical sectional side view of a preferred embodiment of the dispersing device according to the present invention.
Figure 2:
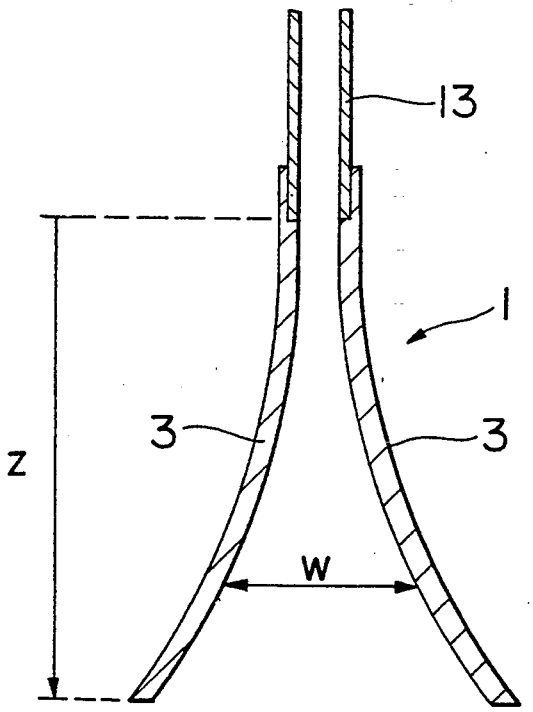
FIG. 2 is a vertical sectional elevational view of the dispersing device shown in FIG. 1.
Figure 3:
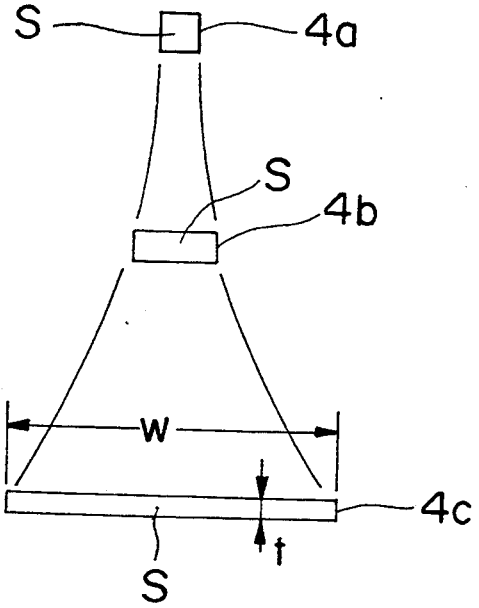
FIG. 3 is a horizontal sectional view of the dispersing device shown in FIG. 2.
Figure 4:
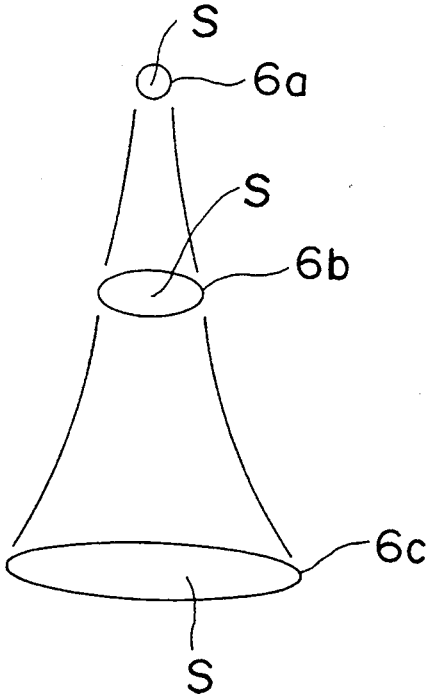
FIG. 4 is a horizontal sectional view of a modification of the dispersing device shown in FIG. 2.
Figure 6:
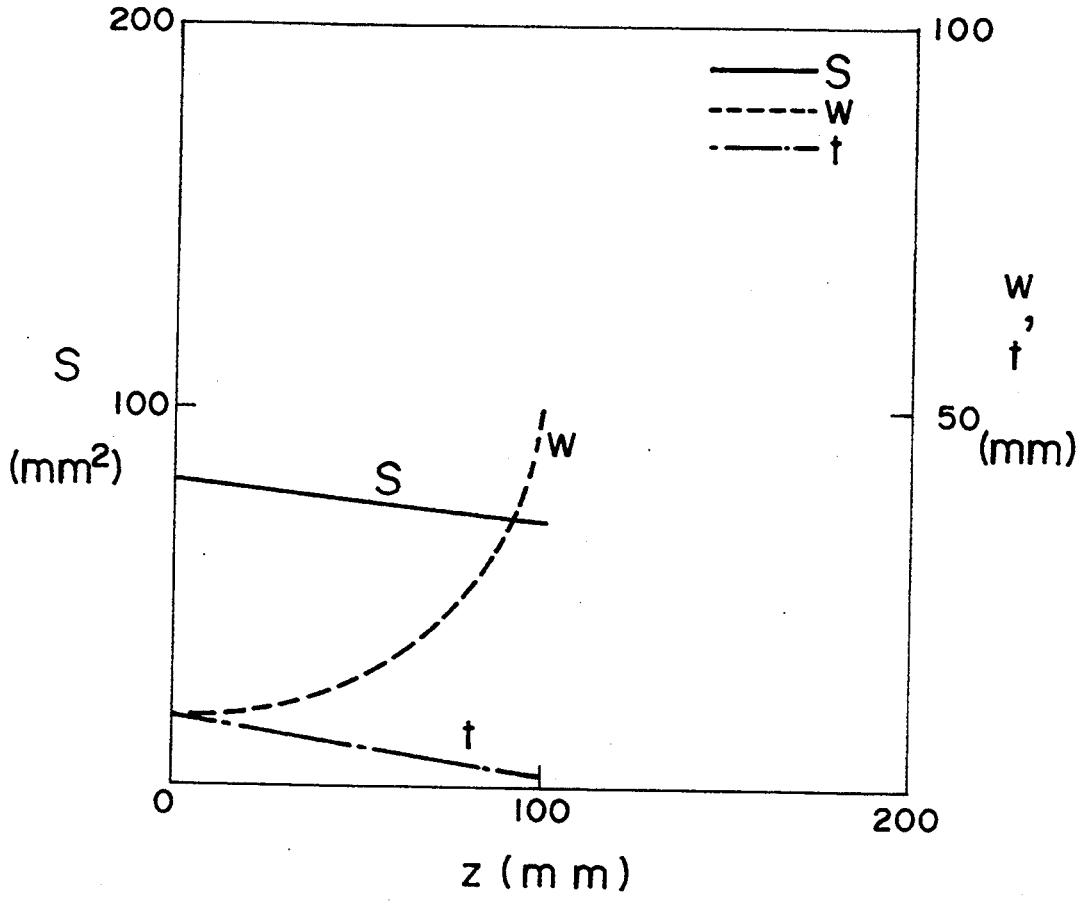
FIG. 6 is a graph showing a relation among a distance z from a filaments inlet to a filament outlet of a dispersing device used in Example 1, a space w between side plates of the dispersing device, a space t between dispersing plates of the dispersing device, and a sectional area S of the dispersing device.
Figure 7:
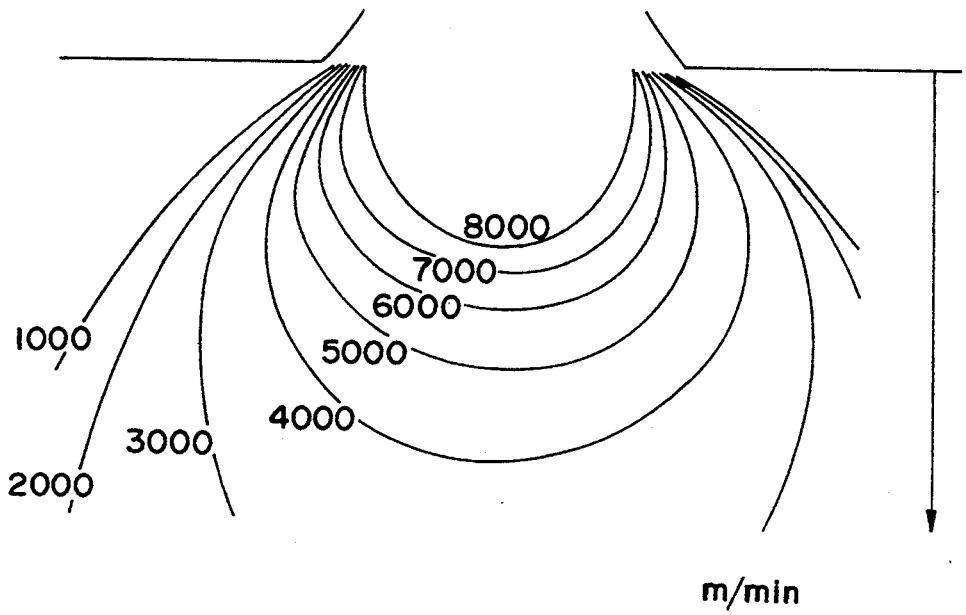
FIG. 7 is an illustration of air velocity distribution in the dispersing device used in Example 1.

A dispersing device having such a shape as to be represented by the space w between the side plates, the space t between the dispersing plates, and the sectional area S of the dispersing pipe as shown in FIG. 6 (i.e., the dispersing device as shown in FIGS. 1 and 2) was mounted in the nonwoven fabric producing apparatus as shown in FIG. 5. Then, the evaluation was carried out. The air velocity distribution is shown in FIG. 7, and the results of the evaluation are shown in Table 1.

COMPARISON 1

Figure 8:
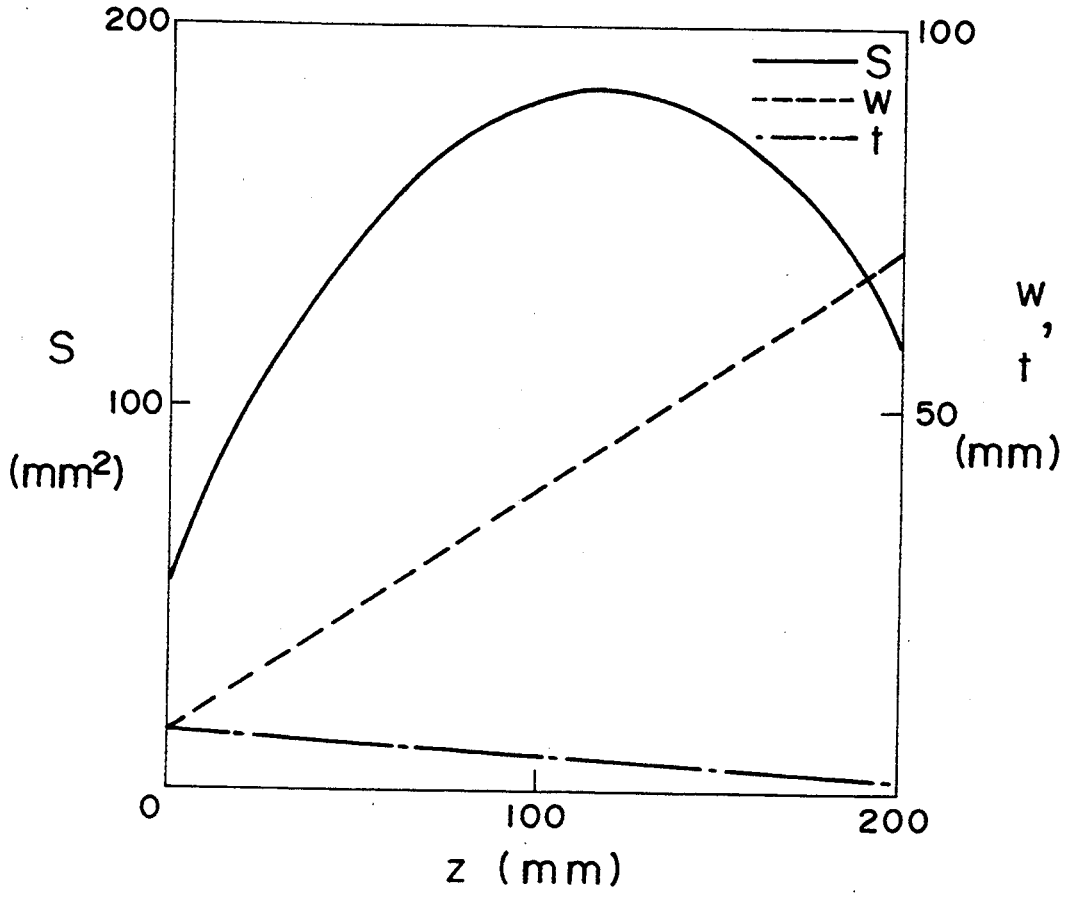
FIG. 8 is a graph showing a relation among a distance z from a filaments inlet to a filament outlet of a dispersing device used in Comparison 1, a space w between side plates of the dispersing device, a space t between dispersing plates of the dispersing device, and a sectional area S of the dispersing device.
Figure 9:
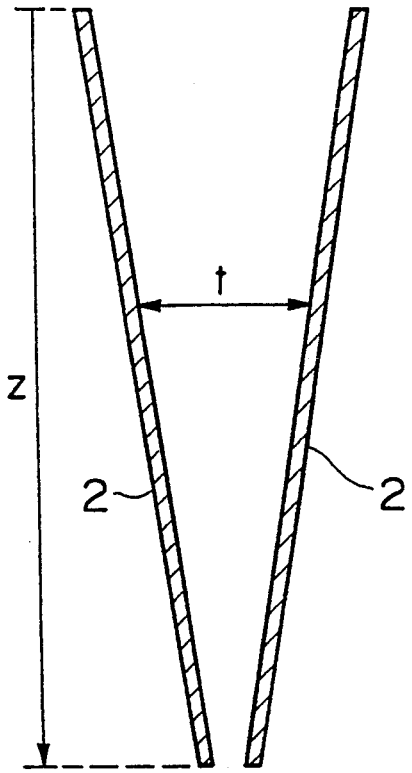
FIG. 9 is a vertical sectional view of the dispersing device used in Comparison 1.
Figure 10:
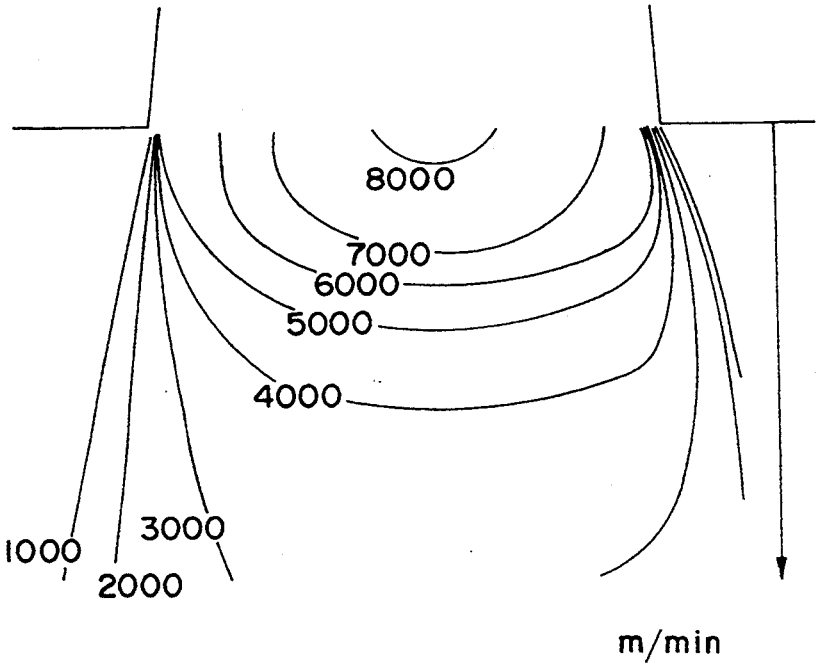
FIG. 10 is an illustration of air velocity distribution in the dispersing device used in Comparison 1.

A dispersing device having such a shape as to be represented by the space w between the side plates, the space t between the dispersing plates, and the sectional area S of the dispersing pipe as shown in FIG. 8 (i.e., the dispersing device as shown in FIGS. 9 and 2) was mounted in the nonwoven fabric producing apparatus as shown in FIG. 5. Then, the evaluation was carried out. The air velocity distribution is shown in FIG. 10, and the results of the evaluation are shown in Table 1.

COMPARISON 2

Figure 11:
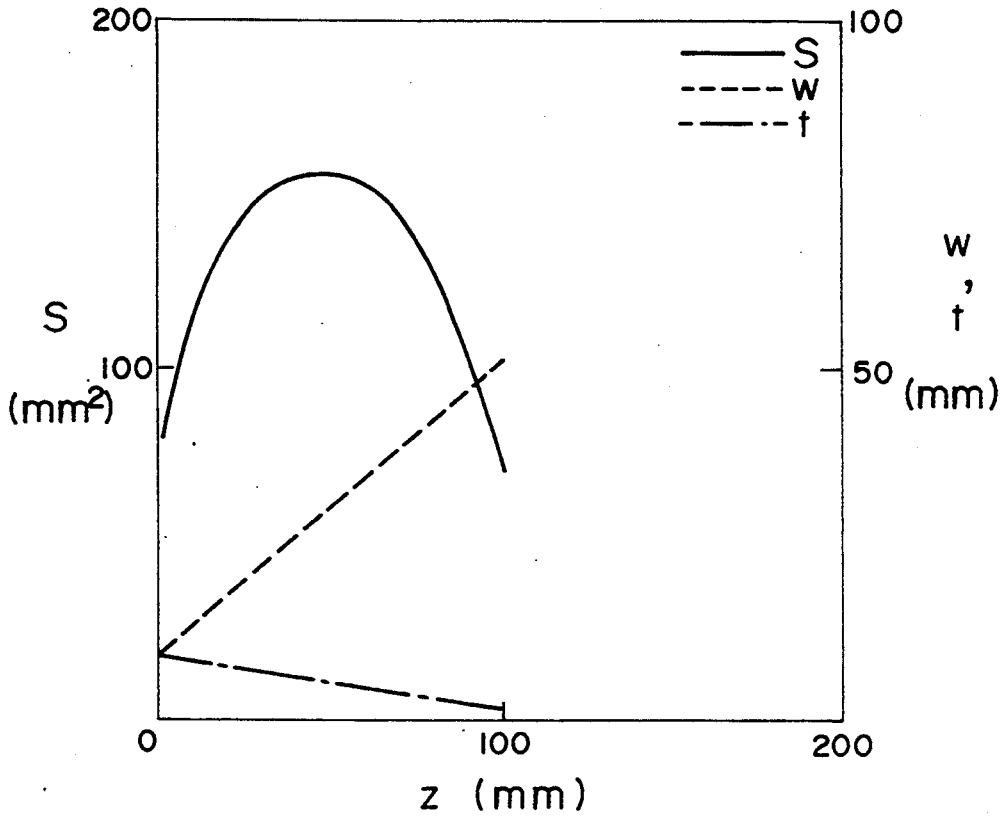
FIG. 11 is a graph showing a relation among a distance z from a filaments inlet to a filament outlet of a dispersing device used in Comparison 2, a space w between side plates of the dispersing device, a space t between dispersing plates of the dispersing device, and a sectional area S of the dispersing device.

A dispersing device having such a shape as to be represented by the space w between the side plates, the space t between the dispersing plates, and the sectional area S of the dispersing pipe as shown in FIG. 11 was mounted in the nonwoven fabric producing apparatus as shown in FIG. 5. The results of the evaluation are shown in Table 1.

In Comparison 2, turbulence of the air flow at the filaments outlet was remarkable, so that the air velocity distribution could not be measured.

COMPARISON 3

Figure 12:
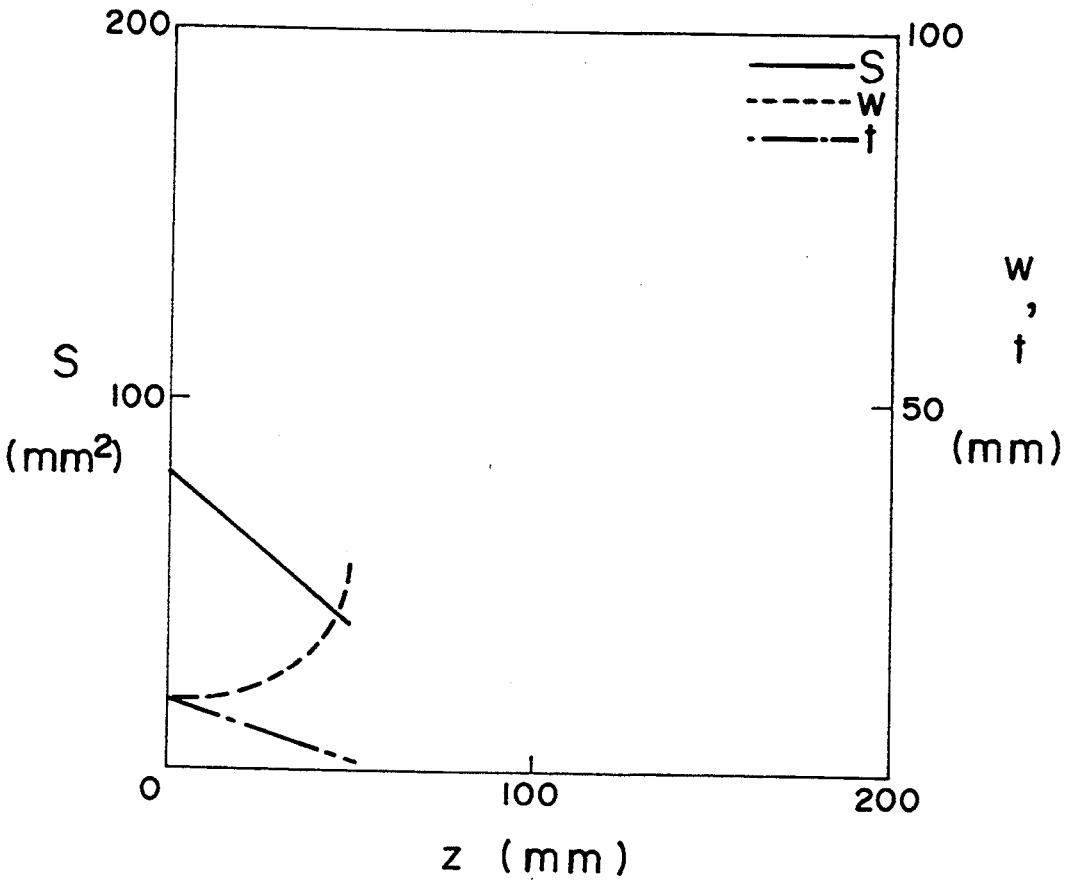
FIG. 12 is a graph Showing a relation among a distance z from a filaments inlet to a filament outlet of a dispersing device used in Comparison 3, a space w between side plates of the dispersing device, a space t between dispersing plates of the dispersing device, and a sectional area S of the dispersing device.

A dispersing device having such a shape as to be represented by the space w between the side plates, the space t between the dispersing plates, and the sectional area S of the dispersing pipe as shown in FIG. 12 was mounted in the nonwoven fabric producing apparatus as shown in FIG. 5. The results of the evaluation are shown in Table 1.

In Comparison 3, the ejected air velocity was beyond a measurable range, so that the air velocity distribution could not be measured. However, it was confirmed that the air velocity along the side plates was remarkably high.

EXAMPLE

Figure 13:
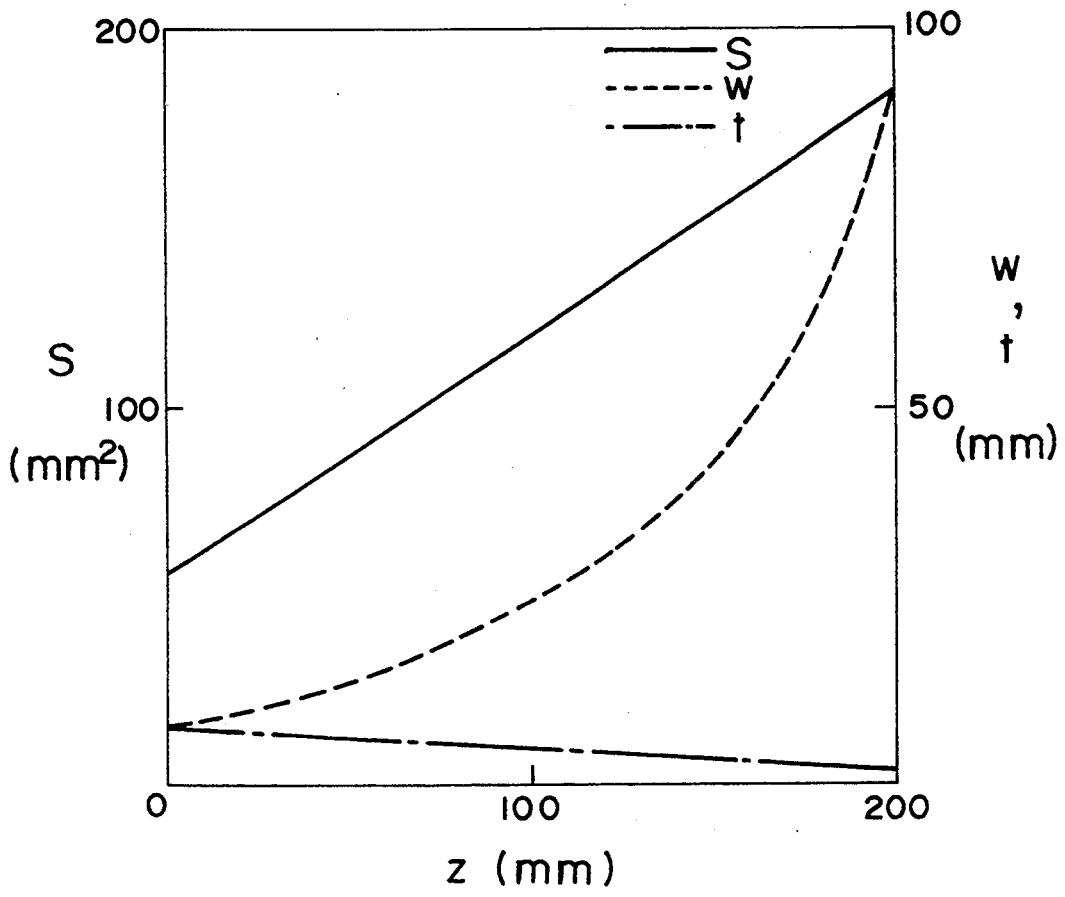
FIG. 13 is a graph showing a relation among a distance z from a filaments inlet to a filament outlet of a dispersing device used in Comparison 4, a space w between side plates of the dispersing device, a space t between dispersing plates of the dispersing device, and a sectional area S of the dispersing device.
Figure 14:
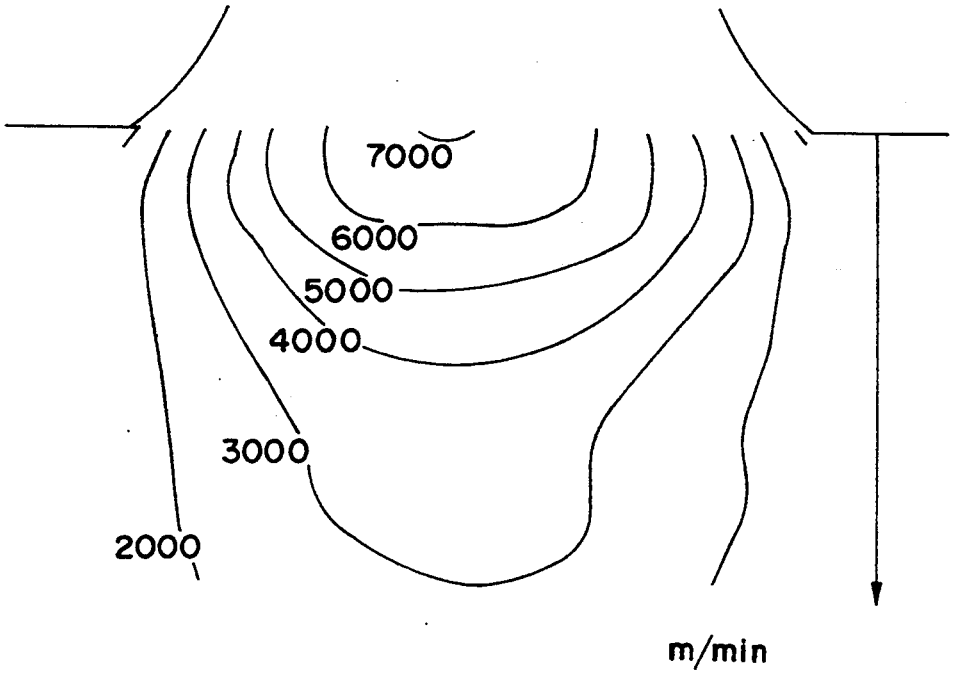
FIG. 14 is an illustration of air velocity distribution in the dispersing device used in Comparison 4.

A dispersing device having such a shape as to be represented by the space w between the side plates, the space t between the dispersing plates, and the sectional area S of the dispersing pipe as shown in FIG. 13 was mounted in the nonwoven fabric producing apparatus as shown in FIG. 5. The air velocity distribution is shown in FIG. 14, and the results of the evaluation are shown in Table 1.

TABLE 1

ATTACHMENT
September 26, 1994

| | S (Send) ($mm^2$) | Va (m/min) | $d^2w/dz^2$ (max) | Dispersion Width (mm) | Web Appearance | Va/Vf |
|---|---|---|---|---|---|---|
| Ex. 1 | S = −0.11z + 81.0 (70) | 10000 | 0.29 | 240 | ○ | 3.3 |
| Ex. 2 | S = 0.64z + 56.25 (183) | 3800 | 0.04 | 100 | ◎ | 1.3 |
| Comp. 1 | S = (0.32z + 7.50) × (−0.03z + 7.50) (120) | 5800 | — | 90 | X | 1.9 |
| Comp. 2 | S = (0.08z + 9.00) × (0.43z + 9.00) (72) | 9700 | — | 75 | X | 3.2 |
| Comp. 3 | S = −0.82z + 81.0 (40) | 17500 | 0.57 | 220 | X | 5.8 |

The criterion of the evaluation of the web appearance in Table 1 is as follows:

◎: very good (uniform and wide dispersion condition with no yarn bundles)

○: good (almost uniform and wide dispersion condition with almost no yarn bundles)

×: bad (uniform and narrow dispersion condition with many yarn bundles)

Industrial Applicability

According to the dispersing device of the present invention, a change in sectional area is small. Therefore, the turbulence of the carrier air flow is reduced to thereby uniformly and widely disperse the filaments on the moving collector surface. Accordingly, a web having a good appearance with less nonuniformity and less yarn bundles as compared with the prior art dispersing device can be obtained. Thus, the dispersing device of the present invention is suitable For the production of a nonwoven fabric.

We claim:

1. A filaments dispersing device for the production of a nonwoven fabric by dispersing filaments carried by an air flow and ejecting said filaments onto a moving collector surface, said filaments dispersing device consisting essentially of a dispersing pipe formed by a pair of dispersing plates extending vertically and disposed opposite to each other and a pair of side plates extending vertically and disposed opposite to each other, said dispersing plates and said side plates being connected at their respective side edges, said dispersing pipe having an upper end formed with a filaments inlet and a lower end formed with an oblong shape filaments outlet surrounded by said dispersing plates and said side plates, said dispersing pipe having a shape such that a distance (t) between said dispersing plates is decreased with an increase in a distance (z) from said filaments inlet toward said filaments outlet, and having a shape such that a distance (w) between said side plates is increased with the increase in the distance (z), a cross-sectional area (S) of said dispersing pipe at a portion thereof in a plane perpendicular to a line along said distance (z) is represented by the formula 1:

$$S=(a)\times(z)+(b) \quad (1)$$

wherein $dw/dz \geqq 0$ and $d^2w/dz^2 \leqq 0.6$ are satisfied for all values of said distance z.

(a) is a constant, $-1.00, \leqq (a) \leqq 1.00$, is a sectional area of said filaments inlet, and said filaments dispersing device having means for introducing air flow and filaments in the filament inlet and having an airflow and filament outlet, wherein an air velocity (Va) at said filaments outlet is represented by Q/Send where (Q) represents a flow rate of said air flow and (Send) represents a sectional area of said filaments outlet, and said air velocity (Va) is related to a filaments velocity (Vf) such that $2\ Vf < Va < 4\ Vf$.

2. The filaments dispersing device of claim 1, wherein said constant (a) in formula 1 is zero.

3. A filaments dispersing device for the production of a nonwoven fabric by dispersing filaments carried by an air flow carrying means and ejecting said filaments onto a moving collector surface, said filaments dispersing device consisting essentially of a dispersing pipe comprising a pair of dispersing plates vertically extending opposite each other and a pair of side plates vertically extending opposite each other so as to connect corresponding side edges of said dispersing plates, said dispersing pipe having an upper end formed with a filaments inlet and a lower end formed with an oblong filaments outlet surrounded by said dispersing plates and said side plates, said dispersing pipe having a shape such that a first distance (t) between said dispersing plates is decreased with an increase in a second distance (z) from said filaments inlet toward said filaments outlet, and a third distance (w) between said side plates is increased with the increase in said second distance (z), wherein a cross-sectional area (S) of said dispersing pipe in a plane perpendicular to a line along said second distance (z) is represented by Formula 1 given below, and $dw/dz \geqq 0$ and $[d^2/dz^2]d^2w/dz^2 \leqq 0.3$ are satisfied for all values of said second distance (z), Formula 1: $S=a\times z+b$ where (a) is a constant satisfying $-1.00 \leqq a \leqq 1.00$, and (b) is a cross sectional area of said filaments inlet, perpendicular to the length of said dispersing pipe.

4. The filaments dispersing device as defined in claim 3, wherein said carrying means carries said filaments with a condition that an air velocity (Va) at said filaments outlet is represented by a ratio of Q/Send where (Q) represents a flow rate of said air flow and (Send) represents a sectional area of said filaments outlet, and that said air velocity (Va) is related with a filaments velocity (Vf) so as to satisfy $2\ Vf < Va < 4\ Vf$.

5. The filaments dispersing device as defined in claim 3, wherein said constant (a) in formula 1 is zero.

6. A filaments dispersing device for the production of a nonwoven fabric by dispersing filaments carried by an air flow carrying means and ejecting said filaments onto a moving collector surface, said filaments dispersing device comprising a dispersing pipe including a pair of dispersing plates vertically extending opposite each other and a pair of side plates vertically extending opposite each other so as to connect corresponding side edges of said dispersing plates, said dispersing pipe having an upper end formed with a filaments inlet and a lower end formed with an oblong filaments outlet surrounded by said dispersing plates and said side plates, said dispersing pipe having a shape such that a first distance (t) between said dispersing plates is decreased with an increase in a second distance (z) from said filaments inlet toward said filaments outlet, and a third distance (w) between said side plates is increased with the increase in said second distance (z), wherein a cross-sectional area (S) of said dispersing pipe in a plane perpendicular to a line along said second distance (z) is represented by Formula 1 given below, and $dw/dz \geqq 0$ and $d^2w/dz^2 \geqq 0.3$ are satisfied for all values of said second distance (z), Formula 1: $S=a\times z+b$ where (a) is a constant satisfying $-1.00 \leqq a \leqq 1.00$, and (b) is a cross sectional area of said filaments inlet, perpendicular to the length of said dispersing pipe, and said filaments dispersing device having means for introducing air flow and filaments in the filament inlet and having an air flow and filament outlet, wherein an air velocity (Va) at said filaments outlet is represented by a ratio of Q/Send where (Q) represents a flow rate of said air flow and (Send) represents a sectional area of said filaments outlet, and said air velocity (Va) is related to a filaments velocity (Vf) such that $2\ Vf < Va\ 4\ Vf$.

7. The filaments dispersing device as defined in claim 6, wherein said constant (a) in Formula 1 is zero.

* * * * *